United States Patent [19]

McNeight et al.

[11] 4,033,105

[45] July 5, 1977

[54] YARN PROCESSING

[75] Inventors: David Leslie McNeight, Congleton; William John Morris, Didsbury, both of England

[73] Assignee: Ernest Scragg & Sons Limited, England

[22] Filed: Feb. 26, 1973

[21] Appl. No.: 335,727

[30] Foreign Application Priority Data

Mar. 6, 1972 United Kingdom ..... 10328/72

[52] U.S. Cl. ..... 57/77.4; 57/157 TS

[51] Int. Cl.[2] ..... D02G 1/04; D01H 7/92

[58] Field of Search ..... 57/1 R, 34 R, 77.3, 57/77.45, 157 TS

[56] References Cited

UNITED STATES PATENTS

| | | | |
|---|---|---|---|
| 1,030,179 | 6/1912 | Hilden | 57/77.4 |
| 2,923,121 | 2/1960 | Tully | 57/77.4 |
| 2,939,269 | 6/1960 | Dobson | 57/77.4 |
| 3,327,463 | 6/1967 | Niina et al. | 57/77.4 |

FOREIGN PATENTS OR APPLICATIONS

| | | |
|---|---|---|
| 1,203,072 | 1/1960 | France |
| 1,222,826 | 4/1960 | Germany |
| 1,228,751 | 11/1960 | Germany |
| 405,943 | 3/1965 | Japan |
| 342,097 | 4/1959 | Japan |
| 920,658 | 3/1963 | United Kingdom |
| 854,780 | 11/1960 | United Kingdom |
| 933,438 | 8/1963 | United Kingdom |

*Primary Examiner*—Donald Watkins
*Attorney, Agent, or Firm*—Larson, Taylor and Hinds

[57] ABSTRACT

Process and apparatus for friction twisting of yarns wherein yarn is caused to travel across the travelling friction surfaces at an angle substantially equal to the desired twist angle so that effects of variations of the friction characteristics and inconsistencies in the twisted yarns are substantially reduced.

16 Claims, 5 Drawing Figures

YARN PROCESSING

This invention is concerned with the processing by twisting of textile yarns of the man-made kind, for instance polyester, polyamide, polyolefin and acrylic yarns.

Friction twisting is one method employed to impart a twist to a yarn e.g. in false twist crimping and has been carried out by causing a travelling yarn to run in contact with a friction surface or surfaces travelling in a direction substantially at right-angles to the direction of yarn travel. The travelling surface has, or surfaces have, been provided at the periphery of a wheel or those of a series of wheels, or by a driven belt or band or a series of such belts or bands, or by the inner surface or surfaces of a rotating bush or a series of bushes. The yarn travel has always been effected by pulling the yarn through the apparatus having the friction false twister so that the yarn tension on the input side of the false twister has always been lower than the tension on the output side.

Such friction twisting as practised however suffers from the facts firstly that yarns differ in their frictional characteristics not only from package to package but also at different points in the length of the yarn in a package, even assuming that the contacting travelling surface in unvarying in character, and secondly that the travelling surfaces vary from one to another and from time to time during their lives. The rollers, bands or belts, or bushes, also wear fairly rapidly and consequently require frequent replacement.

As a result, undesirably wide variations occur in the twist imparted to the yarns and, in the case of false twist crimped yarns, these variations show up as irregularities in bulk and dye uptake.

The inconsistencies experienced with friction twisted yarns are the consequence of effecting the friction twisting operation in the slipping mode, that is operating so that, when in contact with the friction surfaces, the yarn is not only rotated about its lengthwise axis so as to be twisted but also slips or skids to a substantial extent.

The invention seeks to friction twist yarn so that it more nearly has a simple rolling motion due to its contact with a friction surface.

The advantage of such mode of treatment is that, so long as there is sufficient friction between the yarn and the travelling surface to ensure that the yarn rolls without significant slipping or skidding, variations in the frictional characteristics are unimportant because they have a negligible effect on the twist level achieved.

We have found that the abovementioned advantages can be achieved by causing the yarn, whilst in contact with a travelling surface, to travel in a direction making an acute angle with the direction of travel of the travelling surface, which angle can be selected as herein described.

The manner in which the angle may be determined and apparatus of the invention are illustrated diagrammatically in the accompanying drawings in which.

Figure 1:
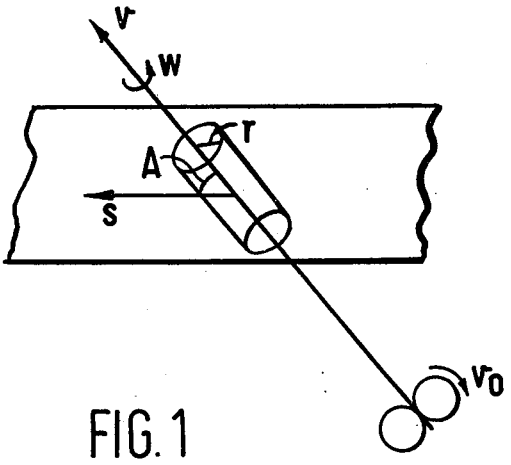
FIG. 1 shows a filament rolling across a travelling surface.

It can be shown theoretically, assuming the yarn to be a cylindrical rod instead of a bundle of filaments (see FIG. 1) that if a yarn of radius $r$ makes at an angle A to the direction of travel of a surface having a speed of travel $s$, and rotates without slip, the resultant rate of rotation $w$ and forward speed of travel of the yarn $v$ are such that $$2\pi r w = s.\sin A = v.\tan A \quad \ldots (1)$$

and thus that $$\tan A = 2\pi r(w/v) \quad \ldots (2)$$

Figure 2:
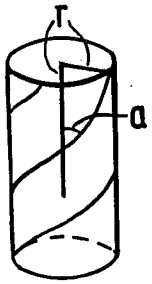
FIG. 2 shows a portion of the filament.

Nominal twist $T$ is given by $$T = w/v_o \quad \ldots (3)$$

where $v_o$ is the speed of travel of the untwisted yarn at entry to the twisting stage. The nominal twist $T$ is related to the actual twist $t$ measured relatively to the twisted length by the relation $$t = kT \quad \ldots (4)$$

where $k$ is the ratio of the untwisted to the twisted yarn lengths or velocities. If feed rollers are provided at the entry to the twisting stage then $v_o$ will be the peripheral velocity of these rollers. The twist angle $a$ (see FIG. 2) is given by $$\tan a = 2\pi rt = 2\pi r(w/v) \quad \ldots (5)$$

and therefore $a = A$.

Accordingly the invention may comprise controlling the yarn path so that the angle A of travel of the yarn over the travelling surface is substantially equal to the desired twist angle $a$.

Since $kr_o^2 = r^2$ where $r_o$ is the untwisted yarn radius, and $v_o = kv$, we have:

$$\tan A = 2\pi r_o T(k)^{3/2} \quad \ldots (6)$$

From the foregoing relationships it is possible to calculate the angle A when it is desired to process a yarn with a particular twist level and to provide guides, or to operate the apparatus, to ensure that the yarn travels in the desired direction in contact with the travelling surface or series of surfaces.

Depending upon the twist level and the number and shape of the filaments, which determine the packing density of the yarn in the twisted state, $k$ can lie within the region 1.1 to 2.0 for normal textile yarns being false twist crimped, e.g. 70 denier at 80 turns per untwisted inch. The value of $r_oT$ depends upon the value of the desired twist level and generally lies within the range 0.01 to 0.18. However there will be cases in which it will be desired to process yarns with values of $k$ and $r_oT$ outside these limits.

Thus it will be seen that approximate theoretical values of tan $A$ can be calculated and it will lie between 0.72 ($A = 36°$) for the lower values of $k$ and $r_oT$, and 3.2 ($A = 73°$) for higher values of $k$ and $r_oT$.

The theoretical value of speed ratio $$s/v = \sec A$$

will then lie between 1.2 to 3.4. This means that the ratio $s/v_o = (\sec A)/k$ which is the more easily measurable ratio of the feed speed to the surface speed, will have theoretical values that lie between about 1.1 and 1.7.

The invention accordingly may further comprise controlling the yarn path so that angle A of travel of the yarn is in the range 30° to 75° according to the denier of the yarn in the range 20 denier to 180 denier and according to the twist angle to be imparted to a yarn of a particular denier. It will be appreciated that yarn angle increases with denier but is different for the same yarns when different twist levels are required.

In practice, however, it may not be such a simple matter to assign accurate values to the parameters. Observed twist angles in a yarn are influenced by factors such as the number of filaments present in the yarn and by filament migration and may not be exactly equal to the values calculated from the above simple expressions. For similar reasons, and because the yarn does not assume the shape of a simple cylinder when twisted, and does not accurately obey the relationship $kr_o^2 = r^2$ the observed values of $s/v_o$ may not be exactly equal to the theoretical values. In addition, if the twisting device comprises friction wheels having rounded yarn contacting edges, the yarn will be in contact with each edge over a length in which the linear surface speed is not constant from point to point since the radii from the wheel axis of successively contacted points will be different. The angle between the yarn and the surface will nevertheless be at or close to the desired yarn twist angle at some point on the surface.

It is a feature of the invention that under these conditions the friction twister assists to forward the yarn with the result that yarn tension on the output side of the friction twister can be chosen as desired to be equal to or more than or less than that on the input side.

Also it will be clear that if a low output side tension is obtained, it is an indication that twisting is being obtained substantially according to the invention.

In many cases. the friction twisting apparatus consists of a number of travelling friction surfaces spaced along the yarn path so that the yarn is simultaneously in contact with the surfaces, all of which are driven so as to impart the same hand of twist. In such cases, the friction surfaces when seen in plan view are distributed around the yarn path so that perpendiculars to the planes (in which the friction surfaces travel) and located at the regions of yarn contact with the surfaces, have a polygonal, e.g. regular polygonal, arrangement and further there may be corresponding to each angle of the polygon a set of surfaces of which these perpendiculars are coincident.

In utilising such apparatus, the arrangement is that each surface is next succeeded along the yarn path by a surface of the set corresponding to an adjacent angle of the polygon considered in the same direction around the polygon in each case.

When the surfaces are provided by the peripheries of overlapping parallel wheels, there may conveniently be three sets of wheels, each set having a common drive spindle parallel to the spindles of the other two sets, and the spindles being distributed around the yarn path so that adjacent wheels of each set have between them a single wheel of each other set, the yarn contact points with the respective sets being at the corners of an equilateral triangle when the wheels are viewed axially.

In experiments utilising such apparatus for friction false twisting, it has been found that the spacing of the spindle axes and the axial disposition of the wheels affect the twist level and inter alia output side yarn tensions. The successive wheels should be arranged so that the yarn progresses naturally from one to the next so as to cross each surface substantially at the desired angle. The output side yarn tension can be utilised to determine the appropriate settings.

For the purpose of the invention therefore either or both of the wheel spacings on their spindles and the spacing of the spindle axes may be made adjustable. For instance the wheels may be spaced apart on their spindle by separate spacers which may be changed to vary the spacing or washers acting as shims may be employed to obtain the desired spacing. Particularly it is found to be necessary to choose the spacing according to the yarn denier and the desired twist level. An effect similar to that of axial adjustment can be obtained by using wheels of different axial thicknesses.

Figure 3:
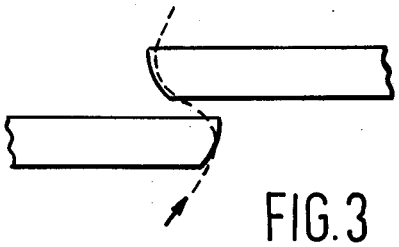
FIG. 3 shows a yarn travelling over two adjacent wheels.

In the experiments utilising overlapping wheels with curved-section peripheral friction surfaces, it has been advantageous, because of the resulting increased ability to obtain desirable closeness of the yarn-contacted regions of successive wheels, to employ tyres of asymmetrical section, for example such as shown in FIG. 3 of the drawings.

Figure 4:
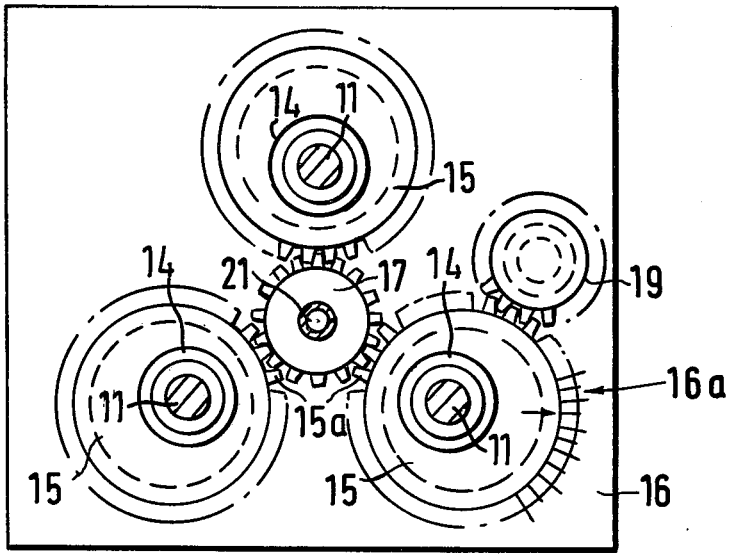
FIG. 4 is a plan view of part of a friction twisting apparatus.
Figure 5:
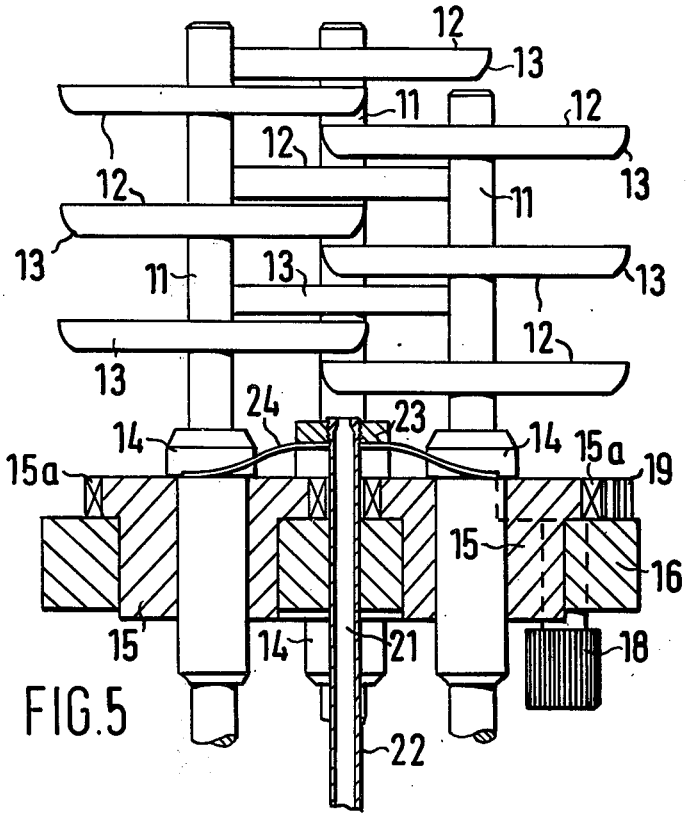
FIG. 5 is an elevation partly in section of the apparatus.

A three-spindle, nine-wheel construction of friction false twister utilising adjustable-position wheels of asymmetrical section is shown in FIGS. 4 and 5 of which:

FIG. 4 is a diagrammatic plan view and

FIG. 5 is an elevation which shows the wheel rim shape and the details of the mechanism for adjusting the spindle spacing.

The friction false twister comprises three parallel spindles 11 each having three wheels 12 having yarn-engaging friction surfaces 13 (not shown in FIG. 4). The wheels 12 overlap when viewed axially and the amount of overlap plays a part in determining the level of twist which is imparted to the yarn, so that adjustment of the spacing of the spindles 11 is provided for. The spindles 11 are shown equiangularly spaced.

The spindles 11 are mounted in bearings 14 mounted in eccentrics 15 carried by a base 16. The eccentrics 15 are similar and are themselves equiangularly spaced. The eccentrics 15 have gear teeth **15*a* meshing with a central toothed wheel 17 by which they are connected for equiangular rotation. A knob 18 having a toothed wheel 19 meshing with one of the eccentrics 15** serves as the adjusting member.

The base 16 has a sleeve yarn passage 21 which continues through the central toothed wheel 17. The sleeve 22 has a threaded end which carries a pressure nut 23 loading a leaf spring 24 which holds the eccentrics 15 on the base 16.

The base 16 and one of the eccentrics 15 can carry calibration marking as indicated at **16*a* in FIG. 4.**

Preferably, the eccentrics 15 are such in relation to the size of the wheels 12 that they can be opened up to reveal a clear passage through the unit, enabling each spindle 11 to be removed individually without having to remove the wheels one by one.

Instead of the central toothed wheel 17, it may be preferable to have an outer toothed ring, if the dimensions of the arrangement are such as to make the wheel 17 somewhat small, and in this case, the adjusting wheel 19 could be dispensed with, since the ring can be conveniently turned by hand for adjustment purposes. Alternatively, toothed wheels can be provided between each pair, or at least two pairs of the eccentrics 15.

The adjustment of the spindle spacing also clearly affects the angle at which the yarn is fed to each wheel.

The invention thus also provides a form of friction twisting apparatus whereof the wheel spacing is such that yarns of normal textile dimensions, for example yarns of 150 denier or even lower, are guided on to each friction surface at an angle to ensure rolling of the yarn without substantial slipping or skidding.

Although in the described arrangement the spindles have an equiangular relationship because it is thought this will be most widely used, it is pointed out that any other angular relationship can be maintained while adjusting the distances between the members and indeed more than three members may be so adjusted. In fact members arranged at the corners of any polygonal figure can be adjusted while retaining their angular relationship if the eccentrics are centred on lines joining the corners of the polygon to the geometric centre and if the eccentric radii are proportional to the lengths of these lines. The geometric centre does not change during rotation of the eccentrics.

We claim:

1. A method of friction twisting a travelling yarn which comprises the steps of causing the yarn to move in contact with a travelling surface in a direction transverse to the direction of travel of the surface and of moving the travelling surface at a selected speed and selected angle in relation to the yarn speed and direction of travel respectively giving the yarn a rolling and substantially slip- or skid-free contact with the surface.

2. A method of friction twisting a travelling yarn which comprises causing the yarn to move in contact across a travelling surface at an angle substantially equal to the twist angle desired to be imparted to the yarn.

3. A method according to claim 2, comprising causing the travelling yarn to contact in succession a plurality of such travelling surfaces, the yarn moving transversely to each of the travelling surfaces at an angle substantially equal to the desired twist angle.

4. A method according to claim 3, wherein each of said travelling surfaces has a curved cross section, and said yarn is guided to travel transversely in contact with each of the surfaces at least at one point substantially at said angle.

5. A method according to claim 2, of twisting a multifilament yarn wherein the angle A, corresponding to the angle at which the yarn moves across the travelling surface is determined by the relationship $$\tan A = 2\pi r_o T (k)^{3/2}$$

where $r_o$ is the radius of the untwisted yarn, $T$ is the nominal twist and $k$ is the ratio of the untwisted to twisted velocities.

6. A method according to claim 5, said angle A being between about 30° and 75°.

7. A method according to claim 3, comprising determining the tensions in the travelling yarn at the input and output sides of the friction twisting apparatus and adjusting the apparatus to make the output side tension lower than the input side tension.

8. A method of friction twisting yarn, wherein the travelling yarn is caused to run in contact with and over the rounded edges of axially spaced overlapping parallel friction wheels rotating about spaced parallel axes, the degree of overlap of the wheels and their axial spacing being such that the yarn path is controlled for the angle of travel of the yarn over the rounded edges of the wheels to be substantially equal to the twist angle desired to be imparted to the yarn.

9. Apparatus for friction false twisting yarn, comprising at least three sets of equally spaced parallel friction wheels with rounded edges, the sets being rotatable about respective common axes which are parallel and equally spaced and are distributed about a yarn path so that adjacent wheels of each set have between them a single wheel of each other set, the spacing of the axes and the axial disposition of the wheels being chosen to provide that the yarn path is so controlled that the angle of travel of the yarn over the rounded edges of the wheels is substantially equal to the twist angle desired to be imparted to the yarn.

10. Apparatus according to claim 9, and including means for adjusting the spacing between the axes of the sets of wheels.

11. Apparatus according to claim 10, said means comprising a plurality of like eccentrics, each eccentric supporting corresponding wheels of a set and being angularly adjustable about the axis of rotation of the set, and a gear wheel coaxial with the yarn path and gear teeth on each of said eccentrics meshing with the centrally disposed gear wheel.

12. Apparatus according to claim 9, comprising also means for effecting adjustment of the axial disposition of the wheels relatively to one another.

13. Apparatus according to claim 9, wherein said rounded surfaces of the wheels are asymmetrical.

14. Apparatus for friction twisting yarn comprising means defining a path for a travelling yarn, at least three sets of travelling surfaces, which are driven to move transversely and in the same sense relatively to the yarn path and which are disposed equiangularly around the yarn path to contact the travelling yarn simmultaneously, each set of surfaces having its surfaces travelling in parallel directions and having between each pair of its surfaces a single one of the travelling surfaces of each other set, and means determining the angle at which the yarn travels in contact across each travelling surface to be substantially the twist angle to be imparted to the yarn.

15. In an apparatus for crimping synthetic threads or the like having three rotatably mounted adjustable spindles each provided with at least one rotationally symmetrical friction element, said spindles lying at the corners of an equilateral triangle in plan view and means for passing a thread which is to be false twisted between the friction elements in a zig-zag path, means for simultaneously adjusting all of said spindles with respect to the path of the thread with the spindles remaining at the corners of an equilateral triangle in plan view in all positions of adjustment with the center of the triangle lying on the path of the thread.

16. In an apparatus for crimping synthetic threads or the like having a carrier; three rotatable spindles, each of said spindles being provided with at least one rotationally symmetrical friction element; means rotationally supporting said spindles on said carrier with the axes of the spindles parallel and positioned at the corners of an equilateral triangle in plan view, said means comprising a separate support for each spindle, said supports being adjustable in the carrier; means for passing a thread which is to be false twisted successively in contact with the friction elements, the yarn travelling in a zig-zag path extending generally in a direction parallel to the spindle axes; an adjustable member movably mounted on the carrier and engaging each of said supports for simultaneously adjusting all of the supports in the carrier to adjust the spindles with the spindles remaining at the corners of an equilateral triangle in all positions of adjustment.

* * * * *

REEXAMINATION CERTIFICATE (343rd)

United States Patent [19]

McNeight et al.

[11] B1 4,033,105

[45] Certificate Issued Apr. 30, 1985

[54] YARN PROCESSING

[75] Inventors: David L. McNeight, Congleton; William J. Morris, Didsbury, both of England

[73] Assignee: Rieter-Scragg Ltd., Macclesfield, England

Reexamination Request:
No. 90/000,591, Jul. 12, 1984

Reexamination Certificate for:

| | |
|---|---|
| Patent No.: | **4,033,105** |
| Issued: | **Jul. 5, 1977** |
| Appl. No.: | **335,727** |
| Filed: | **Feb. 26, 1973** |

[30] Foreign Application Priority Data

Mar. 6, 1972 [GB] United Kingdom ..... 10328/72

[51] Int. Cl.[3] ..... D02G 1/04; D01H 7/92

[52] U.S. Cl. ..... 57/339; 57/332; 57/337; 57/338; 57/340; 57/348

[58] Field of Search ..... 57/332, 334, 336–340

[56] References Cited

U.S. PATENT DOCUMENTS

| | | | |
|---|---|---|---|
| 1,030,179 | 6/1912 | Hilden . | |
| 2,863,280 | 12/1958 | Ubbelohde | 57/157 |
| 2,923,121 | 2/1960 | Tully | 57/77.4 |
| 2,939,269 | 6/1960 | Dobson | 57/77.4 |
| 3,045,416 | 7/1962 | Ubbelohde | 57/77.45 |
| 3,327,463 | 6/1967 | Niina | 57/77.4 |

FOREIGN PATENT DOCUMENTS

| | | |
|---|---|---|
| P1222826 | 8/1966 | Fed. Rep. of Germany . |
| P1228751 | 11/1966 | Fed. Rep. of Germany . |
| 1203072 | 1/1960 | France . |
| 1425246 | 12/1965 | France . |
| 34-2097 | 4/1959 | Japan . |
| 40-3298 | 2/1965 | Japan . |
| 40-5943 | 3/1965 | Japan . |
| 642246 | 8/1950 | United Kingdom . |
| 854780 | 11/1960 | United Kingdom . |
| 920658 | 3/1963 | United Kingdom . |
| 933438 | 8/1963 | United Kingdom . |
| 1083052 | 9/1967 | United Kingdom . |
| 1178397 | 1/1970 | United Kingdom . |
| 1178978 | 1/1970 | United Kingdom . |
| 1185684 | 3/1970 | United Kingdom . |
| 1313255 | 4/1973 | United Kingdom . |

OTHER PUBLICATIONS

Denton, Textile Institute and Industry, Nov. 1971, pp. 307–312.

*Primary Examiner*—Donald Watkins

[57] ABSTRACT

Process and apparatus for friction twisting of yarns wherein yarn is caused to travel across the travelling friction surfaces at an angle substantially equal to the desired twist angle so that effects of variations of the friction characteristics and inconsistencies in the twisted yarns are substantially reduced.

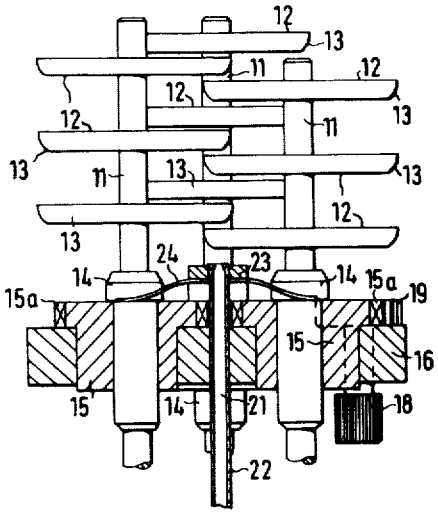

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8–16 is confirmed.

Claims 1, 2, 4, 5 and 7 are determined to be patentable as amended.

Claims 3 and 6, dependent on an amended claim, are determined to be patentable.

1. A method of friction twisting a travelling yarn which comprises the steps of causing the yarn to move in contact with a *plurality of* travelling *peripheral* surfaces *of sets of overlapping discs rotatably arranged on three parallel axes* in a direction *generally* transverse to the direction of travel of the surfaces, and of moving [the] *each* travelling surface at a selected speed and selected angle in relation to the yarn speed, and direction of travel respectively *by said surfaces being so closely spaced and arranged, that each surface controls the yarn with respect to an adjacent such surface* giving the yarn a rolling and substantially slip- or skid-free contact with [the] *each* surface.

2. A method of friction twisting a travelling yarn which comprises causing the yarn to move in contact across a *plurality of* travelling *peripheral* surfaces *of sets of overlapping discs rotatably arranged on three parallel axes, and said surfaces are so closely spaced and arranged that each surface controls the yarn with respect to an adjacent such surface that the yarn crosses each surface* at an angle substantially equal to the twist angle desired to be imparted to the yarn.

4. A method according to claim [3] *2*, wherein each of said travelling surfaces has a curved cross section, and said yarn is guided to travel transversely in contact with each of the surfaces at least at one point substantially at said angle.

5. A method according to claim 2, of twisting a multifilament yarn wherein the angle A, corresponding to the angle at which the yarn moves across [the] *each* travelling surface is determined by the relationship $$\tan A = 2\pi r_o T(k)^{3/2}$$

where $r_o$ is the radius of the untwisted yarn, T is the nominal twist and k is the ratio of the untwisted to twisted velocities.

7. A method according to claim [3] *2* comprising determining the tensions in the travelling yarn at the input and output sides of [the friction twisting apparatus] *the sets of overlapping discs* and adjusting the [apparatus] *discs* to make the output side tension lower than the input side tension.

* * * * *